US005666889A

United States Patent [19]

Evens et al.

[11] Patent Number: 5,666,889

[45] Date of Patent: Sep. 16, 1997

[54] APPARATUS AND METHOD FOR FURNACE COMBUSTION CONTROL

[75] Inventors: Lance J. Evens, Carrollton, Tex.; Michael E. Rose, Chester, Mass.

[73] Assignee: Lennox Industries Inc., Richardson, Tex.

[21] Appl. No.: 410,675

[22] Filed: Mar. 27, 1995

[51] Int. Cl.[6] ..... F23N 5/02

[52] U.S. Cl. ..... 110/190; 236/10

[58] Field of Search ..... 110/187, 190, 110/185, 260; 236/10, 11, 15 BB, 15 BD

[56] References Cited

U.S. PATENT DOCUMENTS

| | | | |
|---|---|---|---|
| 4,602,610 | 7/1986 | McGinnis | 236/11 X |
| 5,340,028 | 8/1994 | Thompson | 236/10 |

*Primary Examiner*—Henry A. Bennett
*Assistant Examiner*—Susanne C. Tinker
*Attorney, Agent, or Firm*—W. Kirk McCord

[57] ABSTRACT

Furnace combustion in a multi-stage or variable input furnace is controlled by operating the furnace in a high fire mode at furnace start-up until the temperature of the products of combustion, or a temperature corresponding to the products of combustion, equals or exceeds a selected temperature. A temperature sensor, preferably a thermostat, is located downstream of the furnace zone of combustion (e.g., in a flue collector box at an outlet from the heat exchanger). The thermostat provides an indication of the products of combustion temperature and has a set point corresponding to the selected temperature. When the products of combustion temperature is less than the selected temperature, the thermostat contacts remain closed. The furnace is operated in the high fire mode while the thermostat contacts remain closed in response to a demand for heating, irrespective of whether the demand is for first stage or second stage heating. When the selected temperature is reached, the thermostat contacts open, thereby allowing the furnace to be operated in either the high fire or in a low fire mode, depending on the level of demand for heating, as indicated by an external room thermostat. By operating the furnace in the high fire mode until the products of combustion temperature reaches a selected temperature (i.e., during cold start-up operation) condensate formation is reduced and room comfort is enhanced by inhibiting air from being supplied to the room at less than a desirable temperature.

16 Claims, 5 Drawing Sheets

APPARATUS AND METHOD FOR FURNACE COMBUSTION CONTROL

TECHNICAL FIELD

This invention relates generally to furnaces and in particular to improved apparatus and method for furnace combustion control in a multi-stage or variable input furnace.

BACKGROUND ART

Before the imposition of stringent efficiency standards by the government, furnaces typically operated with relatively high excess air and high flue temperatures and at relatively low efficiencies. Many of such prior art furnaces used natural draft convection to exhaust products of combustion from the furnace. Under these conditions, condensation was unlikely to result in any appreciable quantities from the products of combustion, even during cold start-up, low fire operation. In addition to the disadvantage of relatively low fuel economy, such furnaces had low discharge temperatures, thereby detracting from space comfort, particularly during low fire, cold start operation.

Higher efficiency furnaces more commonplace today typically operate with lower flue temperatures and less excess air. Products of combustion are exhausted by forced draft blowers, rather than by natural convection. As a result of these design changes, condensation is more likely to occur in the furnace, particularly during low fire, cold start operation.

One approach known in the art for counteracting condensate formation during cold start operation in a multi-stage or variable input furnace is to operate the furnace initially in a high fire mode for a fixed amount of time. Upon expiration of the fixed amount of time, the furnace is operable at either low fire or high fire, depending upon the demand for heating. This type of approach is described in U.S. Pat. Nos. 4,425,930; 4,976,459; and 4,982,721. This approach is somewhat effective in reducing condensation during furnace start-up. However, the fixed amount of time may be more or less than what is actually needed to adequately warm up the furnace and to inhibit condensate formation.

There is, therefore, a need for improved apparatus and method for controlling furnace combustion during cold start-up, in order to reduce condensate formation and enhance space comfort.

DISCLOSURE OF INVENTION

In accordance with the present invention, an apparatus and method are provided for controlling combustion in a furnace having a burner for burning a combustible fuel-air mixture, a heat exchanger in fluid communication with the burner for receiving products of combustion, a combustion air blower for supplying combustion air to the burner and exhausting products of combustion from the furnace, a fuel supply valve operable in at least first and second combustion heat input settings for supplying fuel to the burner. The second combustion heat input setting represents a higher rate of combustion than the first combustion heat input setting.

The present invention includes temperature sensing means for sensing a temperature corresponding to products of combustion temperature and for providing an indication of the sensed temperature, and control means responsive to an external demand for heating for controlling combustion rate in the furnace. The control means controls the fuel supply valve to operate at the second combustion heat input setting in response to the sensed temperature indicating that a selected temperature has not been satisfied. The control means is responsive to the sensed temperature indicating that the selected temperature condition has been satisfied to control the fuel supply valve according to the level of the external demand for heating. If the external demand is for first stage heating, the fuel supply valve is operated in the first combustion heat input setting. If the external demand is for a high level of heating, the fuel supply valve is operated at the second combustion heat input setting. Therefore, the furnace operates on "high fire" during start-up in response to an external demand for heating, irrespective of whether the external demand is for a low level (i.e., first stage demand) of heating or a high level (i.e., second stage demand) of heating.

In accordance with one aspect of the invention, the combustion air blower is operable in at least first and second flow rate settings, the second flow rate setting representing a higher combustion air flow rate than the first flow rate setting. The control means also controls the combustion air blower to operate at the second flow rate setting at furnace start-up until the selected temperature condition has been satisfied. After this temperature condition has been satisfied, the combustion air blower speed is controlled according to the level of demand for heating in a similar manner as described hereinabove with respect to the control of the fuel supply valve.

In accordance with another aspect of the invention, pressure sensing means is provided for sensing combustion air flow pressure and for providing an indication of the sensed pressure. The control means inhibits operation of the fuel supply valve in the second combustion heat input setting in response to the sensed pressure being below a selected pressure. Therefore, if the sensed pressure indicates that the combustion air flow is insufficient to sustain "high tire" operation, the furnace is constrained to operate at low tire, even during start-up and even if there is a second stage demand for heating after start-up.

In one embodiment, the temperature sensing means includes a thermostat located to sense temperature of the products of combustion downstream from a region of the furnace in which combustion of the fuel-air mixture occurs (i.e., the zone of combustion). For example, the thermostat sensor may be located in a flue collector box in communication with an outlet from the heat exchanger. The thermostat has a temperature set point corresponding to a selected temperature indicating satisfaction of the selected temperature condition. During furnace start-up, this thermostat sensor controls the furnace combustion rate such that until the thermostat sensor indicates that the products of combustion temperature has reached the temperature set point, the furnace is operated at the "high fire" rate. When the thermostat indicates that the products of combustion temperature has reached or exceeded the temperature set point, the furnace combustion rate is controlled by an external temperature sensor, such as a room thermostat, in accordance with the level of heating demand (e.g., first or second stage heating demand).

The present invention therefore provides for "high fire" start-up of a multi-stage or variable input furnace, whereby proper furnace warmup is achieved to reduce condensate formation and enhance space comfort by inhibiting air supply to the space at less than a desirable temperature.

BEST MODE FOR CARRYING OUT THE INVENTION

In the description which follows, like pans are marked throughout the specification and drawings with the same respective reference numbers. The drawings are not necessarily to scale and in some instances proportions may have been exaggerated in order to more clearly depict certain features of the invention.

Figure 1:
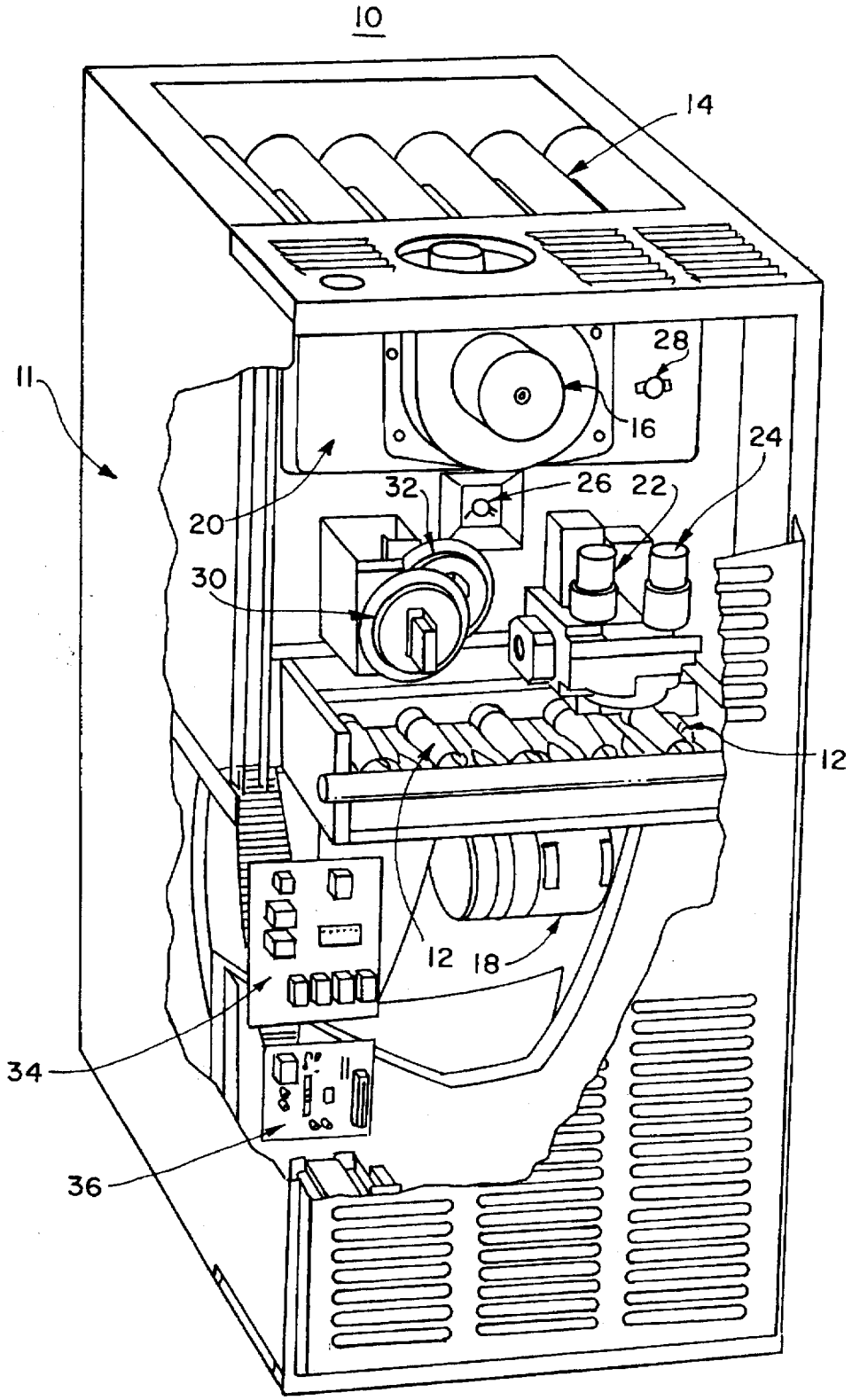
FIG. 1 is a perspective, cutaway view of a multi-stage furnace, according to the present invention.

Referring to FIG. 1, a fuel-burning furnace 10 is housed in a metal cabinet 11. Furnace 10 includes a burner assembly having plurality of burners 12 for burning a combustible fuel-air mixture (e.g., gas-air mixture); a heat exchanger 14 having a plurality of tube bends for receiving products of combustion from burners 12; a combustion air blower 16 for supplying combustion air to burners 12 by induced draft and for exhausting products of combustion from furnace 10; and an air circulation blower 18 for circulating air through cabinet 11, whereby the circulated air is heated by heat exchanger 14 and supplied to an indoor space. Combustion air blower 16 is mounted with a flue collector box 20, which is in fluid communication with an outlet of heat exchanger 14 for receiving products of combustion therefrom.

Furnace 10 is preferably a multi-stage or variable input furnace operable in at least two modes of operation (e.g., low fire and high fire modes). Assuming two stages or two modes of operation, furnace 10 includes two fuel supply valves 22 and 24. In low fire operation, only valve 22 is open to supply fuel to burners 12. In high fire operation, both valves 22 and 24 are open to supply. maximum fuel to burners 12. A temperature limit switch 26 measures the temperature on the discharge side of blower 18, downstream of heat exchanger 14. A thermostat switch 28 is located on collector box 20 for measuring the temperature of the products of combustion therein. Primary and secondary pressure switches 30 and 32, respectively, measure combustion air pressure on the discharge side of blower 16. A burner control board 34 contains electronic components for controlling fuel supply valves 22 and 24. A blower control board 36 contains electronic components for controlling air circulation blower 18. Blowers 16 and 18 are each operable in at least two speed settings corresponding to the at least two modes of operation of furnace 10.

Figure 2:
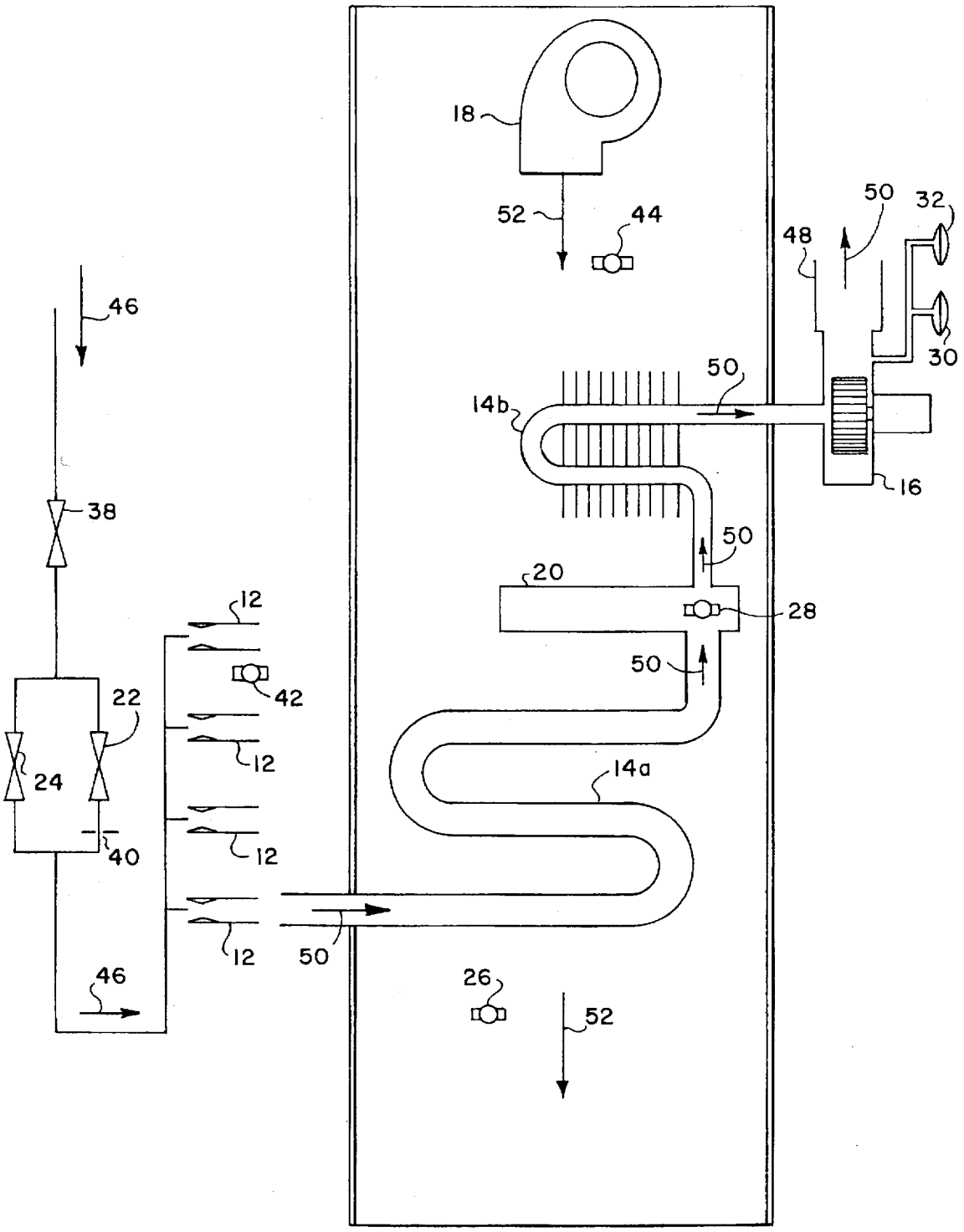
FIG. 2 is a schematic diagram, illustrating the operation of the furnace of FIG. 1.

Referring to FIG. 2, a main fuel supply valve 38 is located upstream of fuel supply valves 22 and 24. A restrictor (preferably an orifice) 40 is located downstream of valve 22 for restricting the fuel flow to burners 12 during low fire operation. During high fire operation, valve 24 is opened to bypass restrictor 40 and provide maximum fuel flow to burners 12. A flame rollout switch 42 is located adjacent burners 12, external to heat exchanger 14, for sensing the presence of flame outside of heat exchanger 14. Temperature limit switch 26 functions as a primary temperature limit switch and is located on the discharge side of blower 18, downstream of heat exchanger 14. A secondary temperature limit switch 44 is located on the discharge side of blower 18, but upstream of heat exchanger 14 in the downflow configuration shown in FIG. 2. In the event of failure of blower 18, limit switch 26 would not detect a high temperature limit condition when furnace 10 is configured for downflow operation, as shown in FIG. 2. Instead, limit switch 44 would be positioned to detect a high temperature limit condition because of the upflow of heated air resulting from natural convection in the event of blower failure. For example, primary limit switch 26 may be set to open at 175° F. and secondary limit switch 44 may be set to open at 150° F.

In FIG. 2, heat exchanger 14 is comprised of a primary heat exchanger **14*a* and a secondary heat exchanger 14*b*. Secondary heat exchanger 14*b* is optional. Flue collector box 20 is located between primary heat exchanger 14*a* and secondary heat exchanger 14*b*. The fuel supply to burners 12 is indicated by arrows 46. Products of combustion are drawn by induced draft through primary and secondary heat exchangers 14*a* and 14*b* by combustion air blower 16 and discharged through a vented flue 48, as indicated by arrows 50. Supply air is discharged by blower 18 across primary and secondary heat exchangers 14*a* and 14*b* as indicated by arrows 52**, whereby the supply air is heated.

Thermostat switch 28 is used to control furnace combustion during start-up. Specifically, furnace 10 operates in the high fire mode during start-up until thermostat switch 28 senses that the temperature of the products of combustion in collector box 20 has reached the temperature set point of thermostat switch 28. Until the set point is reached, switch 28 remains closed. When the temperature set point is reached or exceeded, switch 28 opens. Although switch 28 is shown in FIG. 2 as being located in collector box 20, switch 28 can be located at any other suitable location downstream of the furnace zone of combustion (i.e., the region in which combustion of the fuel-air mixture occurs) for measuring products of combustion temperature or a temperature corresponding to products of combustion temperature, such as the temperature of a component which encloses or is in contact with the products of combustion (e.g., heat exchanger 14 or combustion air blower 16). The operation of furnace 10 will be better understood with reference to FIGS. 3 and 4 and the description which follows.

Figure 3:
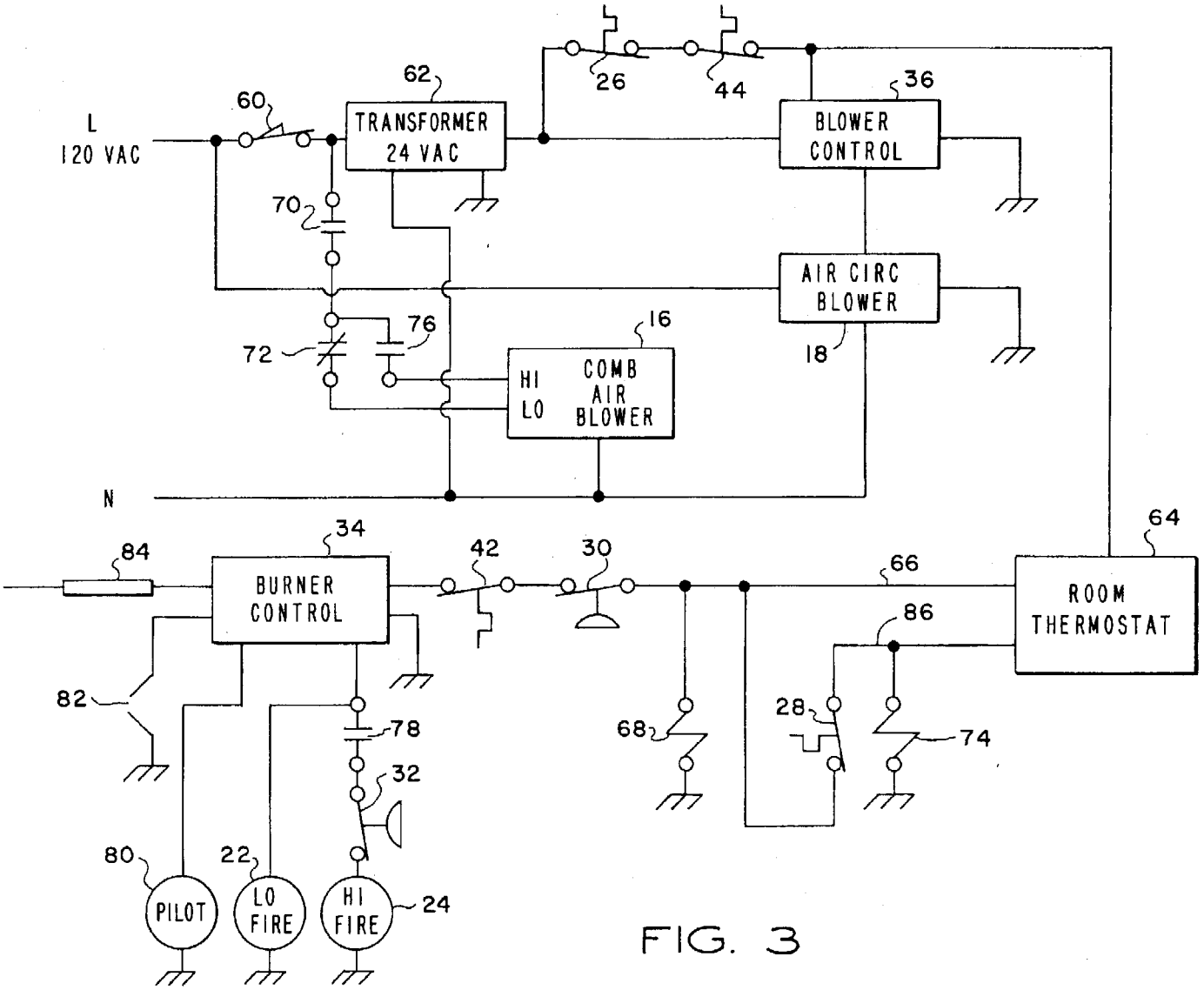
FIG. 3 is an electrical schematic diagram, illustrating control of furnace combustion, according to the present invention.

Referring to FIG. 3, the furnace is powered by 120 volt AC line voltage, supplied on line L with a common return line N. A door interlock switch 60 senses when the door (not shown) to the furnace compartment housing air circulation blower 18 is open and inhibits electrical power to the furnace control components when this door is open or not properly secured. When switch 60 is closed, 120 volt AC is supplied to a step-down transformer 62, which reduces the voltage to 24 volt AC. 24 volt AC power is supplied to blower control 36 and, if primary and secondary temperature limit switches 26 and 44 are closed, to an external thermostat 64, which controls the temperature of an indoor room. If either one of the limit switches 26, 44 is open, electrical power to thermostat 64 is interrupted, which effectively disables furnace operation. Blower control 36 also monitors the condition of limit switches 26 and 44 and, if either one of limit switches 26, 44 is open, blower 18 is operated to remove excess heat from the furnace until both limit switches 26 and 44 are closed.

When thermostat 64 detects a demand for first stage heating (i.e., room temperature is below the temperature set point of thermostat 64 by a predetermined first amount), it outputs a 24 volt AC signal on line 66 to a relay coil 68 and to burner control 34 via primary pressure switch 30 and flame rollout switch 42. 24 volt AC power supplied to relay coil 68 energizes relay coil 68, which closes a normally open relay switch 70, thereby supplying 120 volt AC power through closed relay switch 70 and a normally closed relay switch 72 to operate combustion air blower 16 at low speed. Further, when thermostat switch 28 is closed, a first stage demand for heating signal on line 66 also energizes a relay coil 74 through closed switch 28. When energized, relay coil 74 closes a normally open relay switch 76 and opens normally closed relay switch 72 to supply 120 volt AC to operate blower 16 at high speed. Further, energized relay coil 74 closes normally open relay switch 78, allowing burner control 34 to open both low and high fire valves 22 and 24 for maximum fuel supply to the furnace burners. Both valves 22 and 24 are normally closed, solenoid-operated valves and are opened by 24 volt AC supplied through burner control 34.

Secondary pressure switch 32 must be closed in order to open high fire valve 24. If secondary pressure switch 32 is open, it is an indication that combustion air pressure is insufficient to support high fire operation and only low fire operation will be allowed. If primary pressure switch 30 is open, it is an indication that there is insufficient combustion air to support even low fire operation and 24 volt AC to burner control 34 is interrupted, resulting in closure of both low fire valve 22 and high fire valve 24. Secondary pressure switch 32 is set for a higher pressure than primary pressure switch 30 (e.g., 0.5 inch water column for switch 32 versus 0.2 inch water column for switch 30). Further, if flame rollout switch 42 is open, 24 volt AC to burner control 34 is interrupted, also resulting in closure of both low fire valve 22 and high fire valve 24. Burner control 34 also controls pilot valve 80 and spark electrode 82 and receives input from a flame sensor 84, which monitors the presence of the burner flame.

When the temperature monitored by thermostat switch 28 (i.e., the temperature corresponding to products of combustion temperature) reaches the set point of thermostat switch 28, switch 28 opens, thereby interrupting the 24 volt AC supply to relay coil 74. When electrical power to relay coil 74 is interrupted, relay switch 78 is opened, interrupting the 24 volt AC supply to high fire valve 24 and closing high fire valve 24. When thermostat switch 28 opens, the combustion rate of the furnace is then controlled in response to the level of demand for heating. When there is only a first stage demand for heating, as indicated by a 24 volt AC signal on line 66, only low fire valve 22 is open. Interruption of 24 volt AC to relay coil 74 also opens relay switch 76 and closes relay switch 72 so that 120 volt AC is supplied through closed relay switches 70 and 72 to operate combustion air blower 16 at low speed.

If there is a second stage demand for heating (i.e., room temperature is below the temperature set point of thermostat 64 by a predetermined second mount which is greater than the first mount), as indicated by a 24 volt AC signal on line 86, 24 volt AC is supplied directly to relay coil 74 rather than through thermostat switch 28. Relay coil 74 is again energized, resulting in closure of relay switches 76 and 78 and opening of relay switch 72, so that high fire valve 24 is opened and combustion air blower 16 is operated at high speed to satisfy the second stage demand for heating.

Figure 4A:
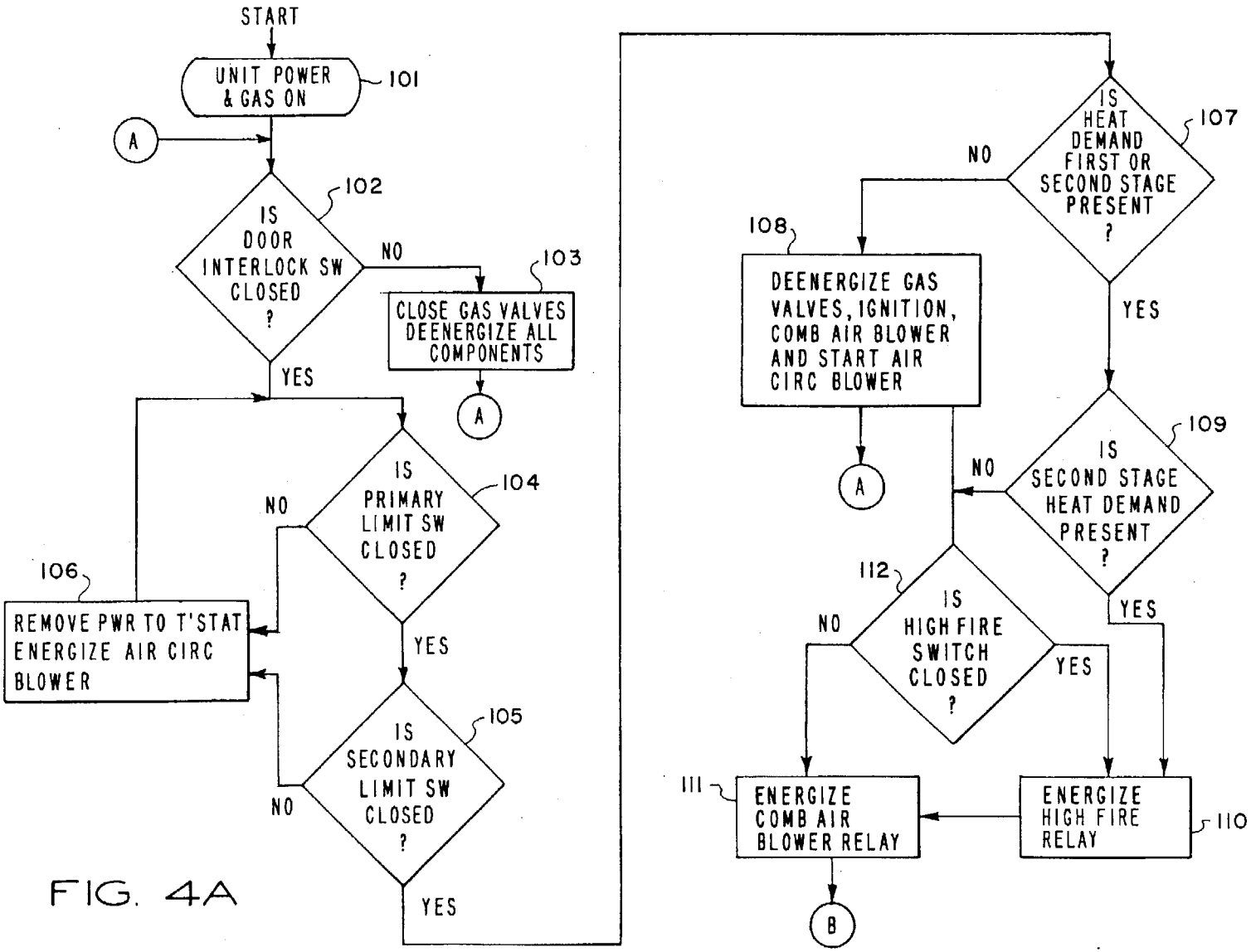
FIGS. 4A and 4B are flow diagrams depicting the operation of the furnace of FIG. 1, including control of furnace combustion, according to the present invention.
Figure 4B:
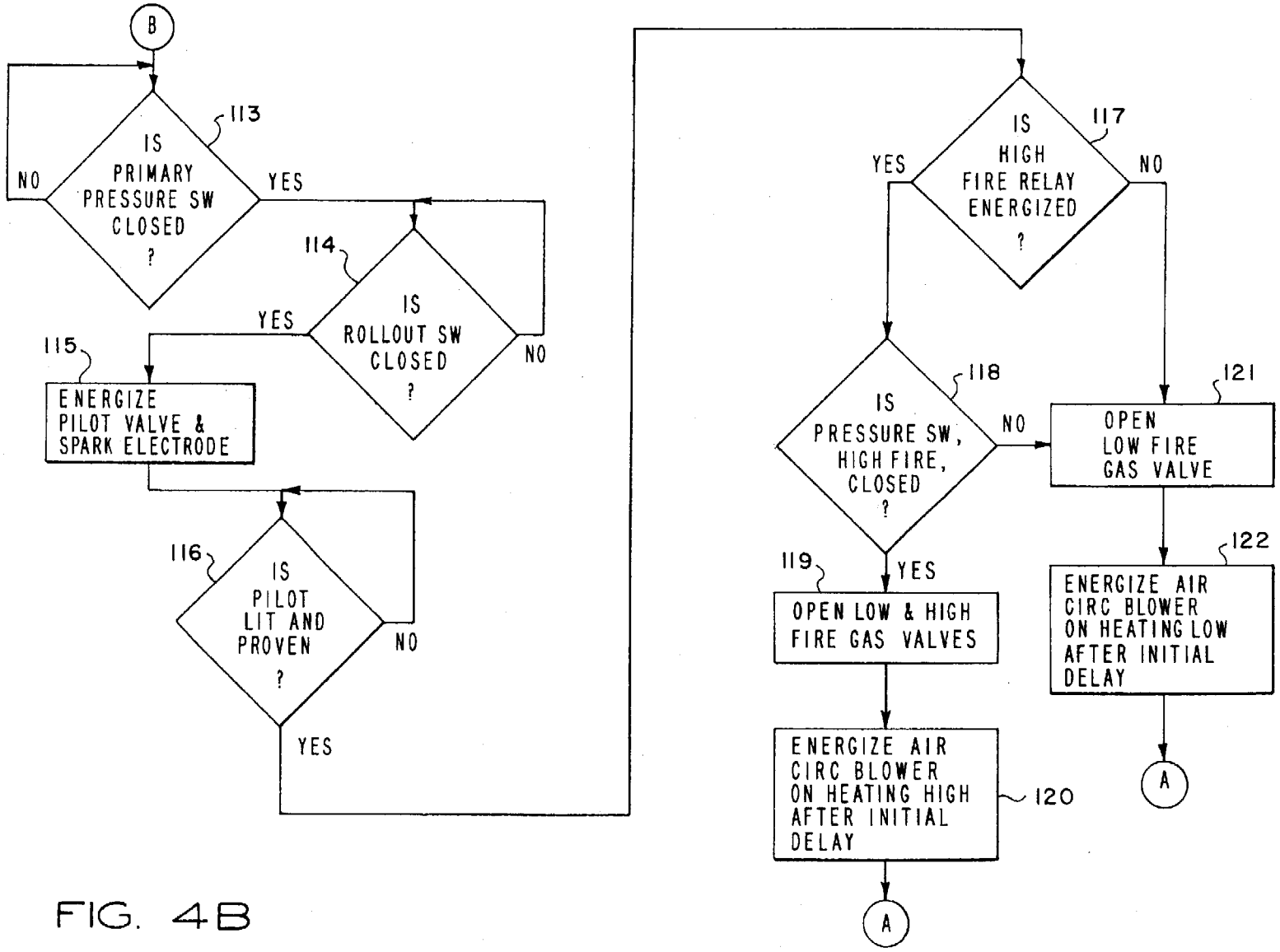

Referring to FIGS. 3, 4A and 4B, upon furnace start-up, 120 volt AC and fuel are supplied to the furnace, pursuant to step 101. If door interlock switch 60 is open, pursuant to step 102, the 120 volt AC supply is interrupted, thereby disabling furnace operation, pursuant to step 103, until switch 60 is closed. If switch 60 is closed, but one of the primary and secondary temperature limit switches 26, 44 is open, pursuant to step 104 or 105, 24 volt AC power is interrupted to thermostat 64, pursuant to step 106. Blower control 36 responds to one of limit switches 26, 44 being open by operating air circulation blower 18 to remove excess heat until both limit switches 26 and 44 are closed. If there is no demand for either first or second stage heating, pursuant to step 107, gas valves 22 and 24 are closed and furnace ignition is de-energized, pursuant to step 108. Further, pursuant to step 108, blower control 36 operates air circulation blower 18 for a selected delay off time (e.g., 30 seconds) to purge the furnace.

If there is a demand for second stage heating, pursuant to step 109, relay coils 74 and 68 are energized, pursuant to steps 110 and 111, respectively, and relay switches 70 and 76 are closed to operate blower 16 at high speed, irrespective of whether thermostat switch 28 is open or closed. However, if there is only a first stage demand for heating, and thermostat switch 28 is closed, pursuant to step 112, it is an indication that the temperature of the products of combustion has not yet reached a temperature corresponding to the set point of thermostat switch 28. In that case, even if there is only a first stage demand for heating, relay coils 74 and 68 are energized and relay switches 70 and 76 are closed to operate combustion air blower 16 at high speed. If switch 28 is open and them is a demand for first stage heating only, only relay coil 68 is energized, pursuant to step 111, and blower 16 is operated at low speed.

If primary pressure switch 30 and flame rollout switch 42 are both closed, pursuant to steps 113 and 114, respectively, burner control 34 opens pilot valve 80 and energizes spark electrode 82 to light the pilot, pursuant to step 115. If one or both of switches 30 and 42 are open, burner control 34 will not light the pilot. Burner control 34 determines whether the pilot has been "proven" (i.e., flame sensor 84 indicates that the pilot has remained on), pursuant to step 116. If thermostat switch 28 is closed or if there is a second stage heating demand, high fire relay 74 is energized, pursuant to step 117. If so and if secondary (high fire) pressure switch 32 is closed, pursuant to step 118, there is sufficient combustion air pressure for high fire operation. Low and high fire gas valves 22 and 24 are opened, pursuant to step 119, and blower control 36 energizes air circulation blower 18 at high speed after an initial blower on delay period (e.g., 30 seconds), pursuant to step 120. If high fire relay 74 is not energized, pursuant to step 117, or if secondary pressure switch 32 is open, pursuant to step 118, burner control 34 opens only low fire gas valve 22, pursuant to step 121, and blower control 36 energizes air circulation blower 18 to operate at low speed after an initial delay period (e.g., 30 seconds), pursuant to step 122.

In accordance with the present invention, a temperature sensor (preferably a thermostat) located downstream of the furnace zone of combustion (i.e., the region where combustion of the fuel-air mixture occurs) is used to measure the temperature of the products of combustion, or a temperature corresponding to the products of combustion temperature, in order to control operation of a multi-stage or variable input furnace during start-up operation. In response to either a first or second stage demand for heating, the furnace operates initially in the high fire mode until the temperature sensor indicates that the temperature of the products of combustion (or the corresponding temperature being measured) has reached a selected temperature consistent with proper furnace warmup. By controlling the furnace to operate initially in the high fire mode, unwanted condensation is reduced and room comfort is enhanced by reducing the likelihood of cool air being blown into the room at furnace start-up. After furnace warmup, the furnace is operated in either the low fire or the high fire mode, depending upon the level of demand for heating.

The best mode for carrying out the invention has now been described in detail. Since changes in and modifications to the above-described best mode made be made without departing from the nature, spirit or scope of the invention, the invention is not to be limited to said details, but only by the appended claims and their equivalents.

We claim:

1. A furnace, comprising:

a burner for burning a combustible fuel-air mixture;

a heat exchanger in fluid communication with said burner for receiving products of combustion;

a fuel supply valve having at least first and second combustion heat input settings for supplying fuel to said burner, said second combustion heat input setting representing a higher rate of combustion than said first combustion heat input setting;

a combustion air blower for supplying combustion air to said burner and for exhausting products of combustion from said furnace;

a temperature sensor located downstream of a zone of combustion in the furnace for sensing temperature of a component of the furnace which encloses products of combustion and for providing an indication of the sensed temperature, the zone of combustion being a region of the furnace in which combustion of the fuel-air mixture occurs; and control means responsive to an external demand for heating and to the sensed temperature for controlling rate of combustion in said furnace, said control means being operable to control said fuel supply valve to operate at said second combustion heat input setting in response to the sensed temperature indicating that a selected temperature condition has not been satisfied, said control means being responsive to the sensed temperature indicating that said selected temperature condition has been satisfied to control said fuel supply valve to operate at said first combustion heat input setting when the external demand is for a first level of heating and to control said fuel supply valve to operate at said second combustion heat input setting when the external demand is for a second level of heating, said second level of heating representing a greater demand for heating than said first level of heating.

2. The furnace of claim 1 further including pressure sensing means for sensing combustion air flow pressure and for providing an indication of the sensed pressure, said control means being responsive to the sensed pressure and being operable to inhibit operation of the fuel supply valve at the second combustion heat input setting in response to the sensed pressure being less than a selected pressure.

3. The furnace of claim 1 wherein the combustion air blower has at least first and second flow rate settings, the second flow rate setting corresponding to a higher rate of combustion air flow than the first flow rate setting, said control means being operable to control the combustion air blower to operate at the second flow rate setting in response to the sensed temperature indicating that said selected temperature condition has not been satisfied, said control means being responsive to the sensed temperature indicating that said selected temperature condition has been satisfied to control the combustion air blower to operate at the first flow rate setting when the external demand is for the first level of heating and to control the combustion air blower to operate at the second flow rate setting when the external demand is for the second level of heating.

4. The furnace of claim 1 wherein said component is a collector box located to receive products of combustion from said heat exchanger, said temperature sensor being located on said collector box to sense the temperature thereof.

5. A furnace, comprising:

burner means for burning a combustible fuel-air mixture;

heat exchanger means in fluid communication with said burner means for receiving products of combustion;

fuel supply valve means having at least first and second combustion heat input settings for supplying fuel to said burner means, said second combustion heat input setting representing a higher rate of combustion than said first combustion heat input setting;

combustion air blower means for supplying combustion air to said burner means and for exhausting products of combustion from said furnace;

temperature sensing means located downstream of a zone of combustion in the furnace for sensing products of combustion temperature and for providing an indication of the sensed temperature, the zone of combustion being a region of the furnace in which combustion of the fuel-air mixture occurs; and control means responsive to an external demand for heating and to the sensed temperature for controlling rate of combustion in said furnace, said control means being operable to control said fuel supply valve means to operate at said second combustion heat input setting in response to the sensed temperature indicating that a selected temperature condition has not been satisfied, said control means being responsive to the sensed temperature indicating that said selected temperature condition has been satisfied to control said fuel supply valve means to operate at said first combustion heat input setting when the external demand is for a first level of heating and to control said fuel supply valve means to operate at said second combustion heat input setting when the external demand is for a second level of heating, said second level of heating representing a greater demand for heating than said first level of heating.

6. The furnace of claim 5 further including pressure sensing means for sensing combustion air flow pressure and for providing an indication of the sensed pressure, said control means being responsive to the sensed pressure and being operable to inhibit operation of said fuel valve supply means at said second combustion heat input setting in response to the sensed pressure being less than a selected pressure.

7. The furnace of claim 5 wherein said combustion air blower means has at least first and second flow rate settings, said second flow rate setting corresponding to a higher rate of combustion air flow than said first flow rate setting, said control means being operable to control said combustion air blower means to operate at said second flow rate setting in response to the sensed temperature indicating that a selected temperature condition has not been satisfied, said control means being responsive to the sensed temperature indicating that said selected temperature condition has been satisfied to control said combustion air blower means to operate at said first flow rate setting when the external demand is for the first level of heating and to control said combustion air blower means to operate at said second flow rate setting when the external demand is for the second level of heating.

8. The furnace of claim 5 wherein said furnace includes collector box means for receiving products of combustion from said heat exchanger means, said temperature sensing means including a temperature sensor located to sense temperature of the products of combustion in said collector box means.

9. In combination:

first temperature sensing means for sensing temperature of an indoor space and for generating a demand for heating signal in response to the indoor space temperature being below a first temperature, said demand for heating signal indicating a first stage demand for heating when the indoor space temperature is below said first temperature by a first predetermined amount, said demand for heating signal indicating a second stage demand for heating in response to said indoor space temperature being below said first temperature by a second predetermined amount, said second predetermined amount being greater than said first predetermined amount; and a furnace, comprising:

burner means for burning a combustible fuel-air mixture;

heat exchanger means in fluid communication with said burner means for receiving products of combustion;

fuel supply valve means having at least first and second combustion heat input settings for supplying fuel to said burner means, said second combustion heat input setting representing a higher rate of combustion than said first combustion heat input setting;

combustion air blower means for supplying combustion air to said burner means and for exhausting products of combustion from said furnace;

second temperature sensing means located downstreams of a zone of combustion in the furnace for sensing a second temperature and for providing an indication of said second temperature, the zone of combustion being a region of the furnace in which combustion of the fuel-air mixture occurs, said second temperature being the temperature of a component of the furnace which encloses products of combustion; and control means responsive to an external demand for heating and said second temperature for controlling rate of combustion in said furnace, said control means being operable to control said fuel supply valve means to operate at said second combustion heat input setting in response to said second temperature being less than a selected temperature, said control means being responsive to said second temperature being equal to or greater than said selected temperature to control said fuel supply valve means to operate at said first combustion heat input setting when said external demand is for said first stage heating and to control said fuel supply valve means to operate at said second combustion heat input setting when said external demand is for said second stage heating.

10. The combination of claim 9 further including pressure sensing means for sensing combustion air flow pressure and for providing an indication of the sensed pressure, said control means being responsive to the sensed pressure and being operable to inhibit operation of said fuel valve supply means in said second combustion heat input setting in response to the sensed pressure being below a selected pressure.

11. Apparatus of claim 9 wherein said combustion air blower means has at least first and second flow rate settings, said second flow rate setting corresponding to a higher rate of combustion air flow than said first flow rate setting, said control means being operable to control said combustion air blower means to operate at said second flow rate setting in response to said second temperature being less than said selected temperature, said control means being responsive to said second temperature being equal to or greater than said selected temperature to control said combustion air blower means to operate at said first flow rate setting when said external demand is for said first level of heating and to control said combustion air blower means to operate at said second flow rate setting when said external demand is for said second level of heating.

12. The combination of claim 9 wherein said component is a collector box located to receive products of combustion from said heat exchanger means, said temperature sensing means being located on said collector box to sense the temperature thereof.

13. A furnace, comprising:

a burner for burning a combustible fuel-air mixture;

a heat exchanger in fluid communication with said burner for receiving products of combustion;

a fuel supply valve having at least first and second combustion heat input settings for supplying fuel to said burner, said second combustion heat input setting representing a higher rate of combustion than said first combustion heat input setting;

a combustion air blower for supplying combustion air to said burner and for exhausting products of combustion from said furnace;

a temperature sensor located downstream of a zone of combustion in the furnace for sensing temperature of a component of the furnace which is in contact with products of combustion and for providing an indication of the sensed temperature, the zone of combustion being a region of the furnace in which combustion of the fuel-air mixture occurs; and control means responsive to an external demand for heating and to the sensed temperature for controlling rate of combustion in said furnace, said control means being operable to control said fuel supply valve to operate at said second combustion heat input setting in response to the sensed temperature indicating that a selected temperature condition has not been satisfied, said control means being responsive to the sensed temperature indicating that said selected temperature condition has been satisfied to control said fuel supply valve to operate at said first combustion heat input setting when the external demand is for a first level of heating and to control said fuel supply valve to operate at said second combustion heat input setting when the external demand is for a second level of heating, said second level of heating representing a greater demand for heating than said first level of heating.

14. The furnace of claim 13 further including a pressure sensor for sensing combustion air flow pressure and for providing an indication of the sensed pressure, said control means being responsive to the sensed pressure and being operable to inhibit operation of the fuel supply valve at the second combustion heat input setting in response to the sensed pressure being less than a selected pressure.

15. The furnace of claim 13 wherein said combustion air blower has at least first and second flow rate settings, said second flow rate setting corresponding to a higher rate of combustion than said first flow rate setting, said control means being operable to control said combustion air blower to operate at said second flow rate setting in response to the sensed temperature indicating that a selected temperature condition has not been satisfied, said control means being responsive to the sensed temperature indicating that said selected temperature condition has been satisfied to control said combustion air blower to operate at said first flow rate setting when the external demand is for the first level of heating and to control said combustion air blower to operate at said second flow rate setting when the external demand is for the second level of heating.

16. The furnace of claim 13 wherein said component is a collector box located to receive products of combustion from said heat exchanger, said temperature sensor being located on said collector box to sense the temperature thereof.

* * * * *